US011682375B2

(12) United States Patent
Sangakkara et al.

(10) Patent No.: US 11,682,375 B2
(45) Date of Patent: Jun. 20, 2023

(54) SPEAKER SYSTEM, SOUND PROCESSING DEVICE, SOUND PROCESSING METHOD, AND RECORDING MEDIUM

(71) Applicant: PANASONIC INTELLECTUAL PROPERTY MANAGEMENT CO., LTD., Osaka (JP)

(72) Inventors: Udeni Sangakkara, Osaka (JP); Takuto Takizawa, Osaka (JP); Eiji Saitou, Osaka (JP); Yukiharu Wakiguchi, Osaka (JP); Minoru Umesako, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 91 days.

(21) Appl. No.: 17/423,065

(22) PCT Filed: Aug. 6, 2019

(86) PCT No.: PCT/JP2019/030891

§ 371 (c)(1),
(2) Date: Jul. 14, 2021

(87) PCT Pub. No.: WO2021/005806

PCT Pub. Date: Jan. 14, 2021

(65) Prior Publication Data

US 2022/0068251 A1 Mar. 3, 2022

Related U.S. Application Data

(60) Provisional application No. 62/871,605, filed on Jul. 8, 2019.

(51) Int. Cl.

| | |
|---|---|
| ***G10K 11/178*** | (2006.01) |
| ***G10L 21/02*** | (2013.01) |
| ***H04R 1/02*** | (2006.01) |

(52) U.S. Cl.

CPC ..... *G10K 11/178* (2013.01); *G10L 21/02* (2013.01); *H04R 1/02* (2013.01); *G10K 2210/108* (2013.01)

(58) Field of Classification Search

CPC .. G10K 11/178; G10K 2210/108; H04R 1/02; H04R 1/10; H04R 1/1008;

(Continued)

(56) References Cited

U.S. PATENT DOCUMENTS

2005/0129224 A1* 6/2005 Piket ..... H04M 9/082 379/406.01

2010/0150383 A1 6/2010 Sampat (Continued)

FOREIGN PATENT DOCUMENTS

JP 2001-345768 A 12/2001
JP 2003-249996 A 9/2003

(Continued)

OTHER PUBLICATIONS

International Search Report and Written Opinion issued in International Patent Application No. PCT/JP2019/030891, dated Oct. 8, 2019; with partial English translation.

(Continued)

*Primary Examiner* — Jason R Kurr

(74) *Attorney, Agent, or Firm* — McDermott Will & Emery LLP

(57) ABSTRACT

A speaker system includes a wearable speaker capable of outputting a first sound which is a voice of a communication partner of a talker and a second sound, a microphone, and a sound processing device which processes a sound output from the wearable speaker and a sound picked up by the microphone. The sound processing device generates a reference signal by synthesizing a first signal indicating the first sound and a second signal indicating the second sound, outputs the first signal and the second signal to the wearable speaker, obtains a sound pickup signal including the voice of the talker from the microphone, performs, on the sound pickup signal, a process of cancelling the sound component (Continued)

output from the wearable speaker by using the reference signal, and outputs the sound pickup signal on which the cancellation process has been performed.

11 Claims, 9 Drawing Sheets

(58) Field of Classification Search
CPC ..... H04R 3/02; H04R 1/1075; H04R 5/0335; H04R 2201/107; H04R 2205/022; G10L 21/02; G10L 21/0208; G10L 2021/02082; H04M 9/082; H04S 3/004
See application file for complete search history.

(56) References Cited

U.S. PATENT DOCUMENTS

2014/0126760 A1* 5/2014 Tse ..... H04R 5/02 381/334
2015/0228266 A1* 8/2015 Higuchi ..... G10K 11/16 381/71.11
2016/0021446 A1* 1/2016 Litovsky ..... H04R 1/2857 381/338
2018/0192226 A1* 7/2018 Woelfl ..... H04R 5/033
2019/0320258 A1 10/2019 Ohura
2020/0366990 A1 11/2020 Goo
2021/0235188 A1* 7/2021 Nishio ..... H04R 1/403
2021/0375302 A1* 12/2021 Hassel ..... H04R 3/12

FOREIGN PATENT DOCUMENTS

JP 2005-303707 A 10/2005
JP 2009-201088 A 9/2009
JP 2012-511869 A 5/2012
WO 2010/068351 A1 6/2010
WO 2018/110161 A1 6/2018
WO 2019/103584 A1 5/2019

OTHER PUBLICATIONS

Extended European Search Report dated Jul. 26, 2022 issued in the corresponding European Application No. 19936782.2.

* cited by examiner

SPEAKER SYSTEM, SOUND PROCESSING DEVICE, SOUND PROCESSING METHOD, AND RECORDING MEDIUM

CROSS-REFERENCE OF RELATED APPLICATIONS

This application is the U.S. National Phase under 35 U.S.C. § 371 of International Patent Application No. PCT/JP2019/030891, filed on Aug. 6, 2019, which in turn claims the benefit of U.S. patent application Ser. No. 62/871,605, filed on Jul. 8, 2019, the entire disclosures of which Applications are incorporated by reference herein.

TECHNICAL FIELD

The present disclosure relates to a speaker system including a wearable speaker, a sound processing device, and a sound processing method which process sound handled by the wearable speaker, and a recording medium.

BACKGROUND ART

When listening to music and the like with over-ear headphones, a feeling of pressure occurs on the head, which puts an increased strain on the head. In addition, lateralization may occur, giving the user a sense of strangeness. In view of the above, a wearable speaker (neck speaker) has been proposed (see, for example, Patent Literature (PTL) 1). As a result, the strain on the head is reduced, and the user is capable of obtaining a realistic sensation by the externalization given by the wearable speaker. For example, in an online game and the like, a lengthy game play is assumed. Hence, it is useful to apply a wearable speaker to listen to the game sound or the voice chat sound of a communication partner.

CITATION LIST

Patent Literature

[PTL 1] International Publication No. WO2018/110161

SUMMARY OF INVENTION

Technical Problem

For example, in an online game and the like, at the same time as using a wearable speaker to listen to the game sound or the voice chat sound of the communication partner, a microphone which picks up the voice of the talker wearing the wearable speaker is often used to transmit the voice of the talker to the communication partner. In such a case, the wearable speaker and the microphone are positioned close to each other, and the sound output from the wearable speaker is also picked up by the microphone. Accordingly, the voice of the talker and the sound output from the wearable speaker are mixed and transmitted to the communication partner, which may make it difficult to hear the voice of the talker. For example, one idea is to lower (mute) the sound from the wearable speaker, while the talker is speaking. However, lowering the sound each time the talker speaks would make the talker feel uncomfortable or strange.

In addition, not limited to online games, but when talking by using the microphone, a smartphone and the like (for example, when a call comes in) while listening to music or the like using a wearable speaker, it is again an idea to lower the sound from the wearable speaker such that the music output from the wearable speaker is not picked up by the microphone.

Accordingly, it is desirable to extract the voice of the talker without lowering the sound from the wearable speaker.

In view of the above, the present disclosure provides a speaker system and the like which is capable of effectively extracting the voice of a talker wearing a wearable speaker.

Solution to Problem

A speaker system according to the present disclosure is a speaker system which includes: a wearable speaker to be worn by a talker, the wearable speaker being capable of outputting a first sound and a second sound which is different from the first sound, the first sound being a voice of a communication partner of the talker; a microphone which picks up a voice of the talker; and a sound processing device which processes a sound output from the wearable speaker and a sound picked up by the microphone. The wearable speaker includes at least two speaker units, the microphone includes at least one microphone unit, and the sound processing device: obtains a first signal which indicates the first sound via a first interface; obtains a second signal which indicates the second sound via a second interface which is different from the first interface; generates a reference signal by synthesizing the first signal and the second signal; outputs the first signal and the second signal to the at least two speaker units; obtains a sound pickup signal including the voice of the talker from the at least one microphone unit; performs, on the sound pickup signal, a cancellation process of cancelling a component of a sound output from the at least two speaker units by using the reference signal; and outputs the sound pickup signal on which the cancellation process has been performed.

A sound processing device according to the present disclosure is a sound processing device which processes a sound output from a wearable speaker to be worn by a talker and a sound picked up by a microphone which picks up a voice of the talker, the wearable speaker being capable of outputting a first sound and a second sound different from the first sound, the first sound being a voice of a communication partner of the talker. The sound processing device: obtains a first signal indicating the first sound via a first interface; obtains a second signal indicating the second sound via a second interface different from the first interface; generates a reference signal by synthesizing the first signal and the second signal; outputs the first signal and the second signal to at least two speaker units included in the wearable speaker; obtains a sound pickup signal including the voice of the talker from at least one microphone unit included in the microphone; performs, on the sound pickup signal, a cancellation process of canceling a component of a sound output from the at least two speaker units by using the reference signal; and outputs the sound pickup signal on which the cancellation process has been performed.

A sound processing method according to the present disclosure is a sound processing method for processing a sound output from a wearable speaker to be worn by a talker and a sound picked up by a microphone which picks up a voice of the talker, the wearable speaker being capable of outputting a first sound and a second sound different from the first sound, the first sound being a voice of a communication partner of the talker. The sound processing method includes: obtaining a first signal indicating the first sound via a first interface; obtaining a second signal indicating the second sound via a second interface different from the first interface; generating a reference signal by synthesizing the first signal and the second signal; outputting the first signal and the second signal to at least two speaker units included in the wearable speaker; obtaining a sound pickup signal including the voice of the talker from at least one microphone unit included in the microphone; performing, on the sound pickup signal, a cancellation process of canceling a component of a sound output from the at least two speaker units by using the reference signal; and outputting the sound pickup signal on which the cancellation process has been performed.

A recording medium according to the present disclosure is a non-transitory computer-readable recording medium for use in a computer, the recording medium having a computer program recorded thereon for causing the computer to execute the sound processing method.

Advantageous Effects of Invention

According to the speaker system and the like in the present disclosure, the voice of a talker wearing a wearable speaker can be effectively extracted.

DESCRIPTION OF EMBODIMENT

Hereinafter, an embodiment will be described in detail with reference to the drawings as appropriate. However, more detailed explanation than necessary may be omitted. For example, detailed explanations of already well-known matters and duplicate explanations for substantially the same configuration may be omitted. This is to avoid unnecessary redundancy of the following description and to facilitate the understanding of those skilled in the art.

It should be noted that the inventors intend to provide the accompanying drawings and the following description in order for those skilled in the art to fully understand the present disclosure, and is not intended to limit the subject matter described in the claims by these.

Embodiment

Hereinafter, an embodiment will be described with reference to FIG. 1 to FIG. 8.

Application Example of Speaker System

First, an application example of a speaker system according to an embodiment will be described with reference to FIG. 1.

Figure 1:
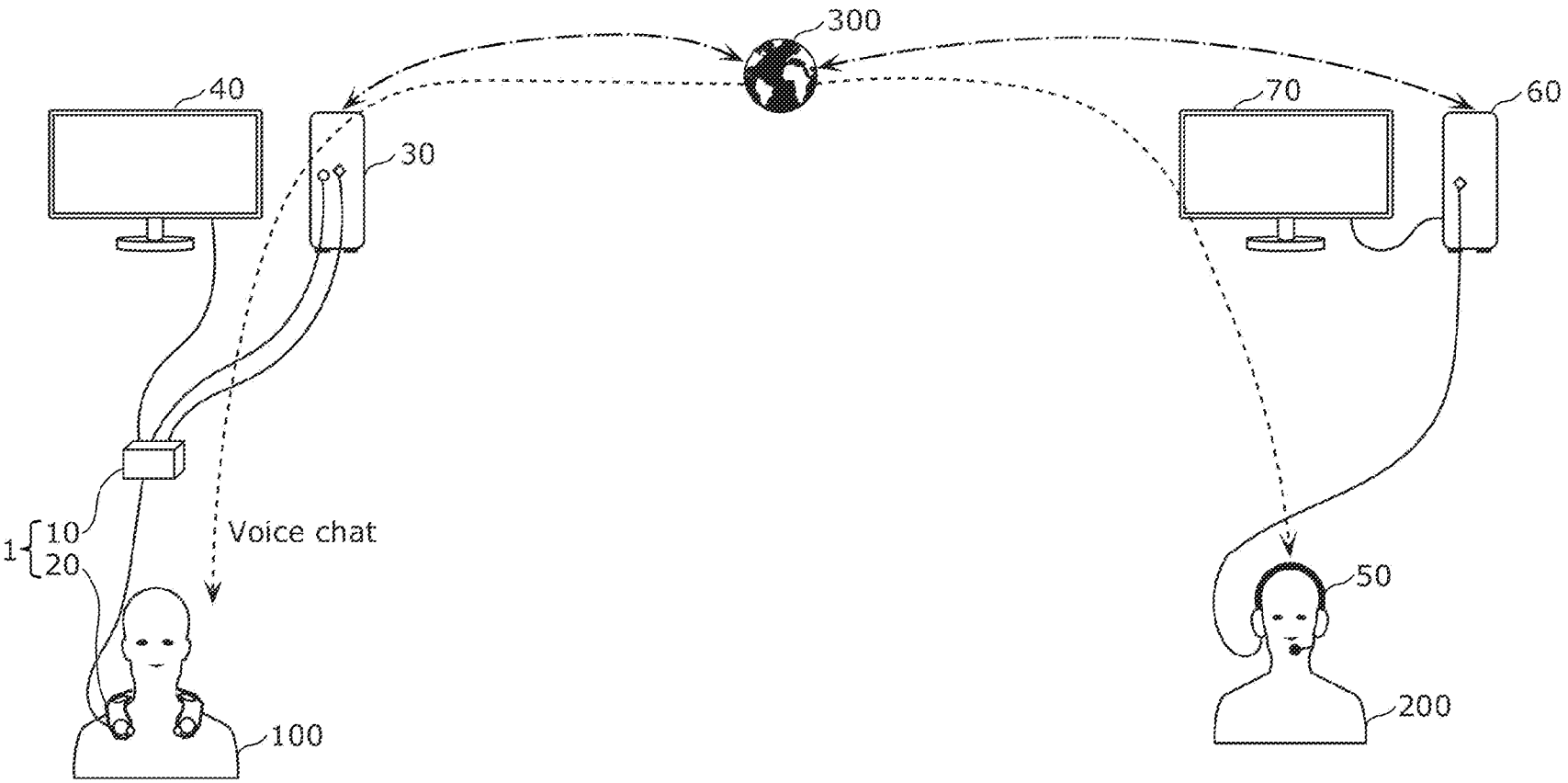
FIG. 1 illustrates an application example of a speaker system according to an embodiment.

FIG. 1 illustrates an application example of speaker system 1 according to an embodiment.

For example, speaker system 1 can be applied to such a system (service) that, while talker 100 and communication partner 200 have a voice chat, sound different from the voices of talker 100 and communication partner 200 are also output to talker 100 and communication partner 200. For example, speaker system 1 can be applied to online games and the like. An example in which talker 100 uses speaker system 1 will be described below. The number of communication partners 200 of talker 100 is not limited to one, but may be two or more.

Speaker system 1 includes sound processing device 10, wearable speaker 20, and microphone 23 (see FIG. 2 to be described later). In the present embodiment, wearable speaker 20 and microphone 23 are integrally provided.

Sound processing device 10 is a computer which processes the sound handled by wearable speaker 20 and microphone 23. For example, sound processing device 10 obtains a first sound, which is the voice of communication partner 200 of talker 100, from personal computer (PC) 30, processes the first sound, and outputs the processed first sound to wearable speaker 20. Sound processing device 10 also obtains a second sound (for example, a game sound) different from the first sound from PC 30, processes the second sound, and outputs the processed second sound to wearable speaker 20. Sound processing device 10 also obtains the sound picked up by microphone 23, processes the sound, and outputs the processed sound to communication partner 200 via, for example, PC 30.

Wearable speaker 20 is a speaker (for example, a neck speaker) to be worn by talker 100 when in use. Wearable speaker 20 is capable of outputting the first sound which is the voice of communication partner 200 of talker 100 and the second sound different from the first sound. Wearable speaker 20 obtains signals for outputting the first sound and the second sound from sound processing device 10. Wearable speaker 20 also includes microphone 23 which picks up the voice of talker 100. Microphone 23 outputs a sound pickup signal including the picked voice of talker 100 to sound processing device 10.

For example, wearable speaker 20 and sound processing device 10 are connected via a wired connection. Although not illustrated, electric power may be supplied to sound processing device 10 via an AC adapter or an interface that is compatible with the universal serial bus (USB) standard, and electric power may be supplied to wearable speaker 20 from sound processing device 10 via a wired connection. This eliminates the need for including a battery, a power supply circuit and the like in wearable speaker 20, leading to a reduction in size and weight of wearable speaker 20. In addition, the wired connection is capable of reducing communication delay as compared with the wireless connection. Wearable speaker 20 and sound processing device 10 may be wirelessly connected.

PC 30 is, for example, a general-purpose computer on which game applications, chat applications, and the like are installed. PC 30 includes various interfaces. For example, PC 30 includes an interface that is compatible with the High-Definition Multimedia Interface (HDMI) (registered trademark) standard. PC 30 further includes, for example, an interface that is compatible with the USB standard, an optical output interface, an analog audio output terminal, a microphone terminal, and the like. PC 30 may also include a DisplayPort, a Digital Visual Interface (DVI), a video graphics array (VGA) connector, and the like. PC 30 is connected to sound processing device 10 via an interface that is compatible with the HDMI standard, an interface that is compatible with the USB standard, an optical output interface, an analog audio output terminal, a microphone terminal, or the like. A chat application installed on PC 30 may include a function of selecting the output destination of the obtained voice chat sound signal (voice signal of communication partner 200). In other words, for example, the output destination of the voice signal of communication partner 200 may be selected from among an interface that is compatible with the HDMI standard, an interface that is compatible with the USB standard, an optical output interface, or an analog audio output terminal. PC 30 may be connected to monitor 40 via DisplayPort, DVI, VGA connector, or the like.

PC 30 is capable of communicating with other computers via network 300 such as the Internet. Accordingly, talker 100 is capable of having a voice chat with communication partner 200, and is also capable of playing an online game with communication partner 200.

Monitor 40 is, for example, a monitor on which a game image is displayed when talker 100 plays a game using PC 30. Monitor 40 obtains, for example, a game image from PC 30 via sound processing device 10, and displays the game image. Monitor 40 may obtain the game image directly from PC 30.

Headset 50 is formed by integrating a speaker and a microphone, and is worn by communication partner 200. Headset 50 outputs the voice of talker 100, the game sound, and the like. Headset 50 obtains signal indicating the voice of talker 100, a game sound, and the like from PC 60. Headset 50 also picks up the voice of communication partner 200. Headset 50 outputs a signal indicating the voice of communication partner 200 that has been picked up to PC 60.

PC 60 is, for example, a general-purpose computer on which game applications, chat applications, and the like are installed. The basic configuration and functions of PC 60 are the same as those of PC 30, and thus, the description thereof will be omitted. PC 60 is connected to headset 50 via an interface that is compatible with the HDMI standard, an interface that is compatible with the USB standard, an optical output interface, an analog audio output terminal, a microphone terminal, or the like. PC 60 is further connected to monitor 70 via an interface that is compatible with the HDMI standard, a DisplayPort, a DVI, a VGA connector, or the like.

Monitor 70 is, for example, a monitor on which a game image is displayed when communication partner 200 plays a game using PC 60. Monitor 70 obtains, for example, a game image from PC 60 and displays the game image.

Configuration of Wearable Speaker

Next, a configuration of wearable speaker 20 will be described with reference to FIG. 2.

Figure 2:
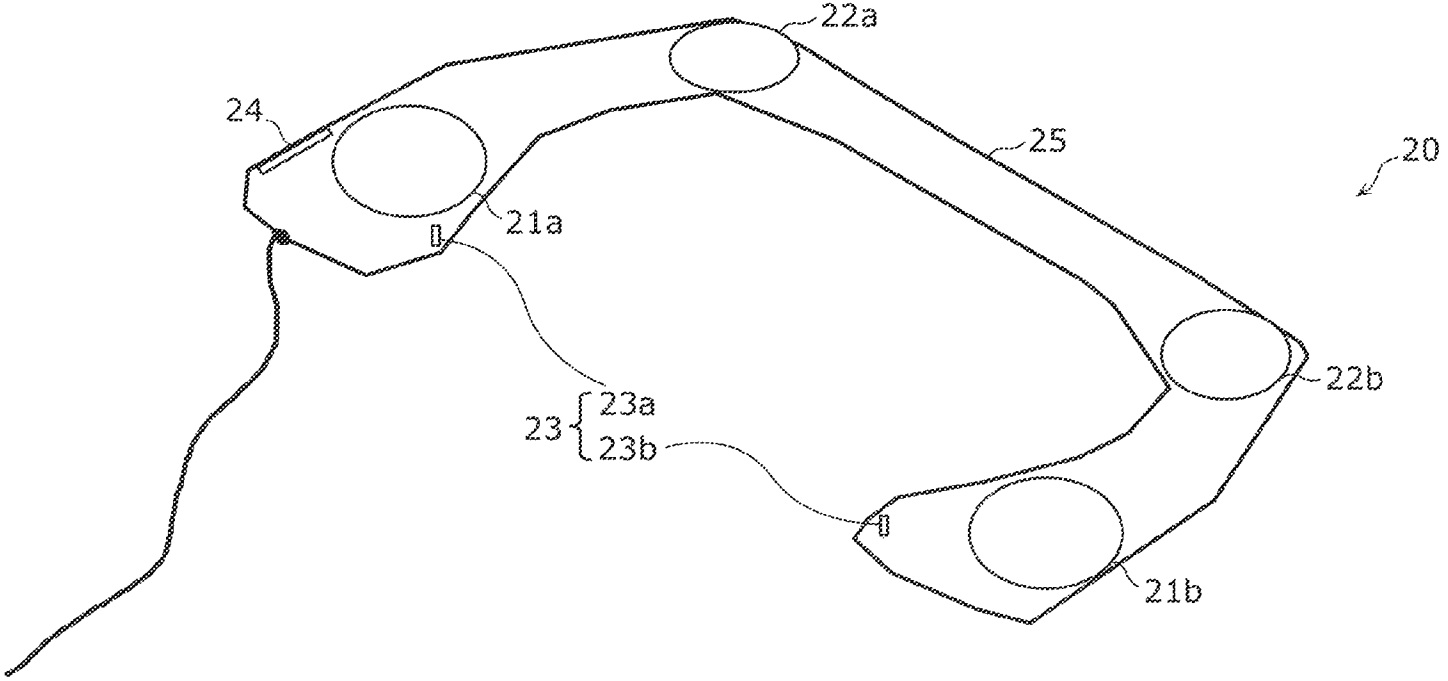
FIG. 2 illustrates an example of a configuration of a wearable speaker according to the embodiment.

FIG. 2 illustrates an example of a configuration of wearable speaker 20 according to the embodiment.

Wearable speaker 20 is a speaker to be worn by a person for use. Wearable speaker 20 is a neck speaker which includes connector 25 and is worn on the neck of a person by connector 25 being hung around the neck of the person. Connector 25 is made of, for example, a flexible material. Moreover, signal lines, which are connected to a speaker unit, a microphone unit, a switch and the like to be described later, pass through connector 25. In the present embodiment, wearable speaker 20 is worn by talker 100.

Wearable speaker 20 includes at least two speaker units. The at least two speaker units include speaker units positioned beside or behind talker 100 when wearable speaker 20 is worn by talker 100. The at least two speaker units also include a speaker unit positioned in front of talker 100 when wearable speaker 20 is worn by talker 100. For example, the at least two speaker units include two or more speaker units positioned beside or behind talker 100 and two or more speaker units positioned in front of talker 100 when wearable speaker 20 is worn by talker 100.

In the present embodiment, wearable speaker 20 includes, as the at least two speaker units, speaker units 21*a* and 21*b* positioned in front of talker 100 and speaker units 22*a* and 22*b* positioned behind talker 100 when wearable speaker 20 is worn by talker 100. As described above, in the present embodiment, speaker system 1 is a multichannel (4-channel) system which includes four speaker units. Speaker unit 21*a* is a front R speaker positioned at the front right side of talker 100. Speaker unit 21*b* is a front L speaker positioned at the front left side of talker 100. Speaker unit 22*a* is a rear R speaker (surround R speaker) positioned at the rear right side of talker 100. Speaker unit 22*b* is a rear L speaker (surround L speaker) positioned at the rear left side of talker 100. Speaker units 21*a*, 21*b*, 22*a* and 22*b* are arranged on connector 25.

Note that speaker system 1 may include a speaker provided separately from wearable speaker 20. For example, the speaker provided separately from wearable speaker 20 may be a speaker provided integrally with sound processing device 10. In such a case, wearable speaker 20 does not have to include speaker units 21*a* and 21*b* which are the front L/R speakers, and the sound output from speaker units 21*a* and 21*b* may be output from the speaker provided separately from wearable speaker 20.

Wearable speaker 20 may include a speaker provided separately from wearable speaker 20, in addition to speaker units 21*a*, 21*b*, 22*a* and 22*b*. For example, speaker units 21*a* and 21*b* and the speaker provided separately from wearable speaker 20 may output the same sound at the same time, or one of them may be selected for outputting the sound.

The number of speaker units included in wearable speaker 20 is not particularly limited as long as at least two speaker units are included. The number of speakers provided separately from wearable speaker 20 is not particularly limited, either.

Microphone 23 for picking up the voice of talker 100 includes at least one microphone unit. In the present embodiment, microphone 23 includes two microphone units 23*a* and 23*b* as the at least one microphone unit. In the present embodiment, wearable speaker 20 and microphone 23 are integrally provided, and microphone units 23*a* and 23*b* are arranged on connector 25. Microphone units 23*a* and 23*b* are positioned in front of talker 100 (around the mouth of talker 100) when wearable speaker 20 is worn by talker 100. For example, microphone units 23*a* and 23*b* are realized by a micro electro mechanical systems (MEMS) microphone.

Wearable speaker 20 also includes switch 24. Talker 100 is capable of adjusting the volume of the sound output from each speaker unit by operating switch 24.

Since wearable speaker 20 is used by connector 25 being hung around the neck of talker 100, a feeling of pressure is less likely to occur on the ears and head of talker 100, unlike over-ear headphones. In addition, unlike the over-ear headphones, wearable speaker 20 does not easily cause sweat on the ears and the head even when used for a long period of time. Moreover, because wearable speaker 20 does not easily get dirty due to sweat, it is easy to maintain. Moreover, unlike over-ear headphones, wearable speaker 20 is unlikely to mess up the hairstyle of talker 100.

Furthermore, the speaker units of wearable speaker 20 are arranged around talker 100; and thus, it is possible to give talker 100 a realistic sensation (for example, a feeling of being surrounded by sound). For example, lateralization is generated also by surround headphones, but externalization can be generated by wearable speaker 20. Since wearable speaker 20 is worn by talker 100, even if talker 100 moves around within the wired connection range or the wireless connection range, so-called a sweet spot also moves to the optimum position according to the movement of the talker.

Moreover, use of wearable speaker 20 does not cover the ears like headphones, so that talker 100 is also capable of hearing the sound of the ambient environment, which can give talker 100 a sense of security.

By including, in wearable speaker 20, a function for giving vibration to the body of talker 100 according to the sound output from wearable speaker 20, it is possible to reduce the fatigue of talker 100 or to allow talker 100 to hardly feel the weight of wearable speaker 20.

Configuration of Sound Processing Device

Next, a configuration of sound processing device 10 will be described with reference to FIG. 3 to FIG. 5.

First, a first example of a configuration of sound processing device 10 will be described with reference to FIG. 3.

Figure 3:
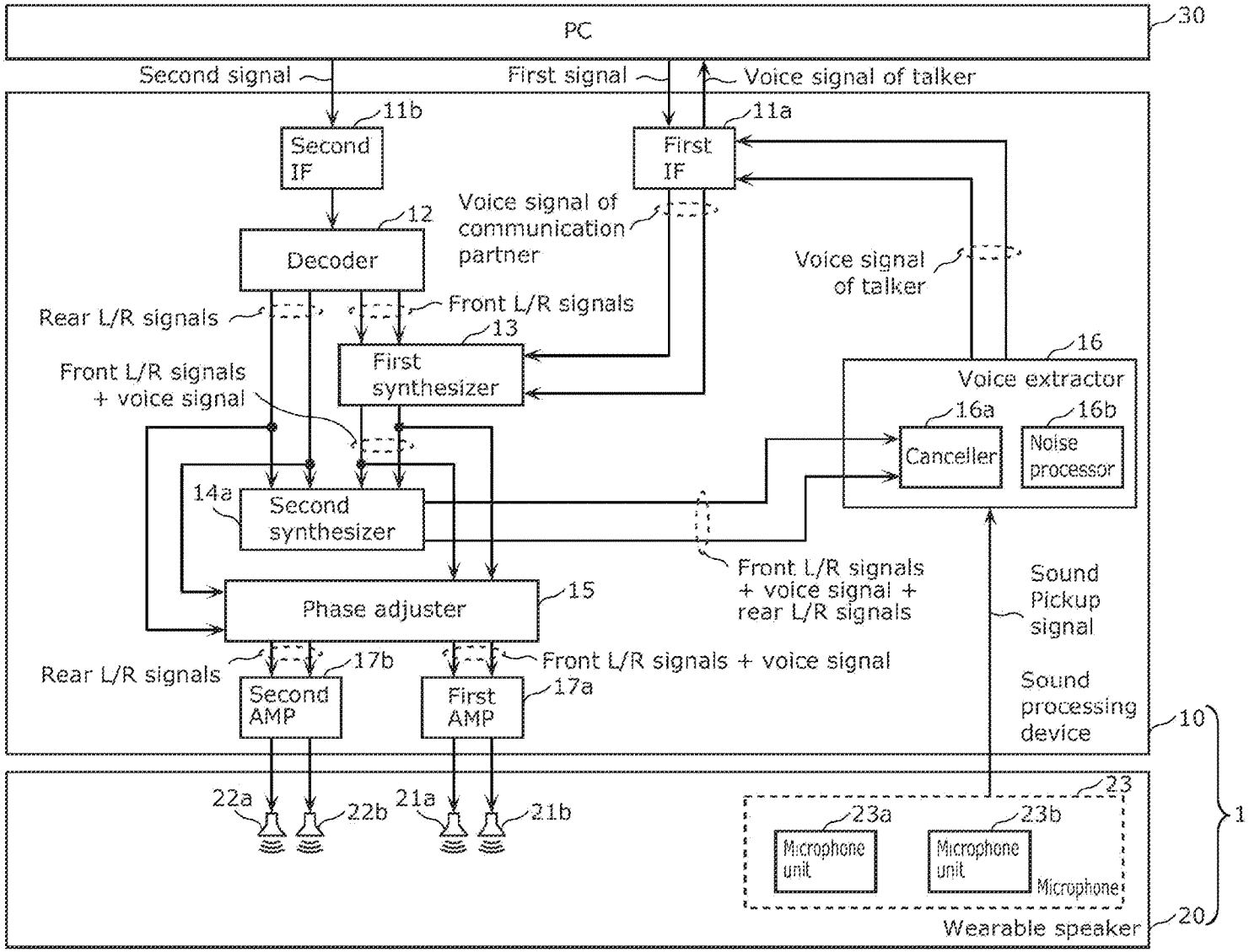
FIG. 3 illustrates a first example of a configuration of a sound processing device according to the embodiment.

FIG. 3 illustrates a first example of a configuration of sound processing device 10 according to the embodiment. FIG. 3 also illustrates wearable speaker 20 and PC 30 in addition to sound processing device 10.

Sound processing device 10 includes first interface (first IF) 11*a*, second interface (second IF) 11*b*, decoder 12, first synthesizer 13, second synthesizer 14*a*, phase adjuster 15, voice extractor 16, first amplifier (AMP) 17*a*, and second AMP 17*b*.

First IF 11*a* is an interface for obtaining a first signal indicating a first sound which is the voice of communication partner 200 of talker 100. First IF 11*a* is, for example, an interface that is compatible with the USB standard, and is an interface capable of inputting and outputting signals to and from PC 30. For example, the first signal is obtained via first IF 11*a*, and the sound pickup signal indicating the voice of talker 100 picked up by microphone 23 is output to PC 30 via first IF 11*a*. First IF 11*a* does not have to be an interface capable of inputting and outputting signals to and from PC 30, but may be an interface capable of only inputting signals. The signal handled by first IF 11*a* may be a digital (differential pulse width modulation (PWM) signal or an analog signal. For example, first IF 11*a* may be an optical input interface which obtains an optical signal output as a first signal from the optical output interface included in PC 30. Moreover, for example, first IF 11*a* may be an auxiliary (AUX) terminal which obtains an analog sound signal output as a first signal from the analog audio output terminal included in PC 30. When first IF 11*a* is an interface capable of only inputting signals, sound processing device 10 may further include an output interface for outputting the sound pickup signal.

Second IF 11*b* is an interface different from first IF 11*a*, and is an interface for obtaining a second signal indicating a second sound different from the first sound. The second sound is, for example, a game sound. In an online game and the like, it is important for talker 100 to know from which position (direction) the sound in the game (attack sound, approaching sound, etc.) is coming from relative to the target in the game operated by talker 100. In view of the above, the second signal obtained by second IF 11*b* includes sound position information, and, for example, the audio format of the second signal is bitstream. The second signal includes sound position information (coordinate information) in the left-right direction and the height direction in the form of metadata. Second IF 11*b* is an interface capable of transmitting such position information together with a sound signal and the like (in other words, an interface capable of transmitting such position information without loss of the position information), and is an interface that is compatible with, for example, the HDMI standard. An interface compatible with the HDMI standard is capable of transmitting image, sound, and control signals with a single interface. Second IF 11*b* is not limited to an interface compatible with the HDMI standard as long as position information can be transmitted together with the sound signals and the like.

For example, second IF 11*b* may obtain not only a sound signal but also an image signal, and the obtained image signal may be output to monitor 40. Second IF 11*b* does not have to obtain the image signal. The image signal may be directly output from PC 30 to monitor 40 via a DisplayPort, DVI, VGA connector, or the like.

Decoder 12 is a processor which decodes the second signal. Decoder 12 determines whether or not the signal obtained by second IF 11*b* includes position information (whether or not the audio format of the signal is bitstream). When the signal includes the position information, decoder 12 decodes the position information, and distributes and outputs the second signal to each of at least two speaker units (here, speaker units 21*a*, 21*b*, 22*a* and 22*b*) included in wearable speaker 20 by using the decoded position information. At this time, decoder 12 applies a pseudo surround effect to each of the distributed second signals and outputs the signals to the subsequent stage. The front L/R signals illustrated in FIG. 3 indicate the second signal distributed to speaker units 21*a* and 21*b* which are the front L/R speakers. The rear L/R signals illustrated in FIG. 3 indicate the second signal distributed to speaker units 22*a* and 22*b* which are the rear L/R speakers. Moreover, decoder 12 adjusts the sampling frequency of the second signal to the sampling frequency of the first signal (for example, 48 kHz) such that first synthesizer 13 to be described later synthesizes the first signal and the second signal. Decoder 12 is compatible with various channel configurations which include a channel configuration including a front speaker and a rear speaker. For example, here, decoder 12 distributes a signal to four speaker units (four channels). However, the number of speaker units the signal is to be distributed is not limited to four, but the signal can be distributed according to the number of speaker units included in speaker system 1.

First synthesizer 13 synthesizes the front L/R signals (second signal) output to speaker units 21*a* and 21*b* which are the front L/R speakers, and the voice signal (first signal) of communication partner 200. As a result, speaker units 21*a* and 21*b* are capable of outputting the first sound which is the voice of communication partner 200, together with the second sound which is a game sound or the like. In multichannel speaker system 1 as in the present embodiment, talker 100 is capable of easily and naturally hearing the voice of communication partner 200 from speaker units 21*a* and 21*b* positioned in front of talker 100.

Second synthesizer 14*a* synthesizes the front L/R signals and the voice signal of communication partner 200 synthesized by first synthesizer 13, with the rear L/R signals to be output to speaker units 22*a* and 22*b* which are the rear L/R speakers. The sound pickup signal picked up by microphone 23 includes front L/R signals and rear L/R signals which are the second signal, and the voice signal of communication partner 200 which is the first signal. In order that canceller 16*a* to be described later cancels these signals, second synthesizer 14*a* synthesizes the synthesized signal of the front L/R signals and the voice signal of communication partner 200 with the rear L/R signals.

Phase adjuster 15 is a processor which adjusts the phase of a signal. For example, the process performed by first synthesizer 13 generates a phase difference between the signals output from speaker units 21*a* and 21*b* and the signals output from speaker units 22*a* and 22*b*. Phase adjuster 15 then adjusts the phase of each signal so as to reduce the phase difference.

First AMP 17*a* amplifies the synthesized signal of the front L/R signals and the voice signal of communication partner 200 to such a level that can be output from speaker units 21*a* and 21*b* which are the front L/R speakers, and outputs the amplified signal to speaker units 21*a* and 21*b*.

Second AMP 17*b* amplifies the rear L/R signals to such a level that can be output from speaker units 22*a* and 22*b* which are the rear L/R speakers, and outputs the amplified signals to speaker units 22*a* and 22*b*.

The first sound and the second sound are output from speaker units 21*a*, 21*b*, 22*a* and 22*b* of wearable speaker 20, based on the front L/R signals, the rear L/R signals and the voice signal of communication partner 200. Since microphone 23 (microphone units 23*a* and 23*b*) is arranged so as to be positioned around the mouth of a person, microphone 23 can also pick up the sound output from speaker units 21*a*, 21*b*, 22*a* and 22*b* arranged at positions such that the output sound can be heard by the ears of the person. Hence, when microphone 23 picks up the voice of talker 100, microphone 23 may also pick up the first sound and the second sound output from speaker units 21*a*, 21*b*, 22*a* and 22*b*.

Voice extractor 16 obtains the sound pickup signal picked up by microphone 23, and performs a process of extracting the voice of talker 100. Voice extractor 16 includes canceller 16*a* and noise processor 16*b* as functional structural elements for performing the extraction process.

Canceller 16*a* performs, on the sound pickup signal, a process of cancelling the sound components output from speaker units 21*a*, 21*b*, 22*a* and 22*b*. The sound pickup signal can include, in addition to the voice of talker 100, the front L/R signals, the rear L/R signals and the voice signal of communication partner 200 output from speaker units 21*a*, 21*b*, 22*a* and 22*b*. The front L/R signals, the rear L/R signals, and the voice signal of communication partner 200 are originally handled by sound processing device 10, and are signals output from sound processing device 10 to each speaker unit. Hence, canceller 16*a* is capable of cancelling the components of the sound output from speaker units 21*a*, 21*b*, 22*a* and 22*b* and included in the sound pickup signal, by using the reference signal generated by second synthesizer 14*a* by synthesizing the front L/R signals, the rear L/R signals, and the voice signal of communication partner 200. For example, canceller 16*a* performs an echo cancelling process. Specifically, canceller 16*a* is capable of extracting the voice signal of talker 100 from the sound pickup signal by adding a signal in which the phase of the reference signal is inverted to the sound pickup signal. Canceller 16*a* then outputs the extracted voice signal of talker 100 to first IF 11*a*, and outputs the voice signal of talker 100 to PC 30 via first IF 11*a*.

The sound pickup signal can include noise around talker 100 (microphone 23) in addition to the voice of talker 100. Accordingly, noise processor 16*b* detects the noise around microphone 23 and performs a process of eliminating or reducing the noise. The method for realizing the process is not particularly limited, and any generally used method may be applied.

Next, a second example of the configuration of sound processing device 10 will be described with reference to FIG. 4.

Figure 4:
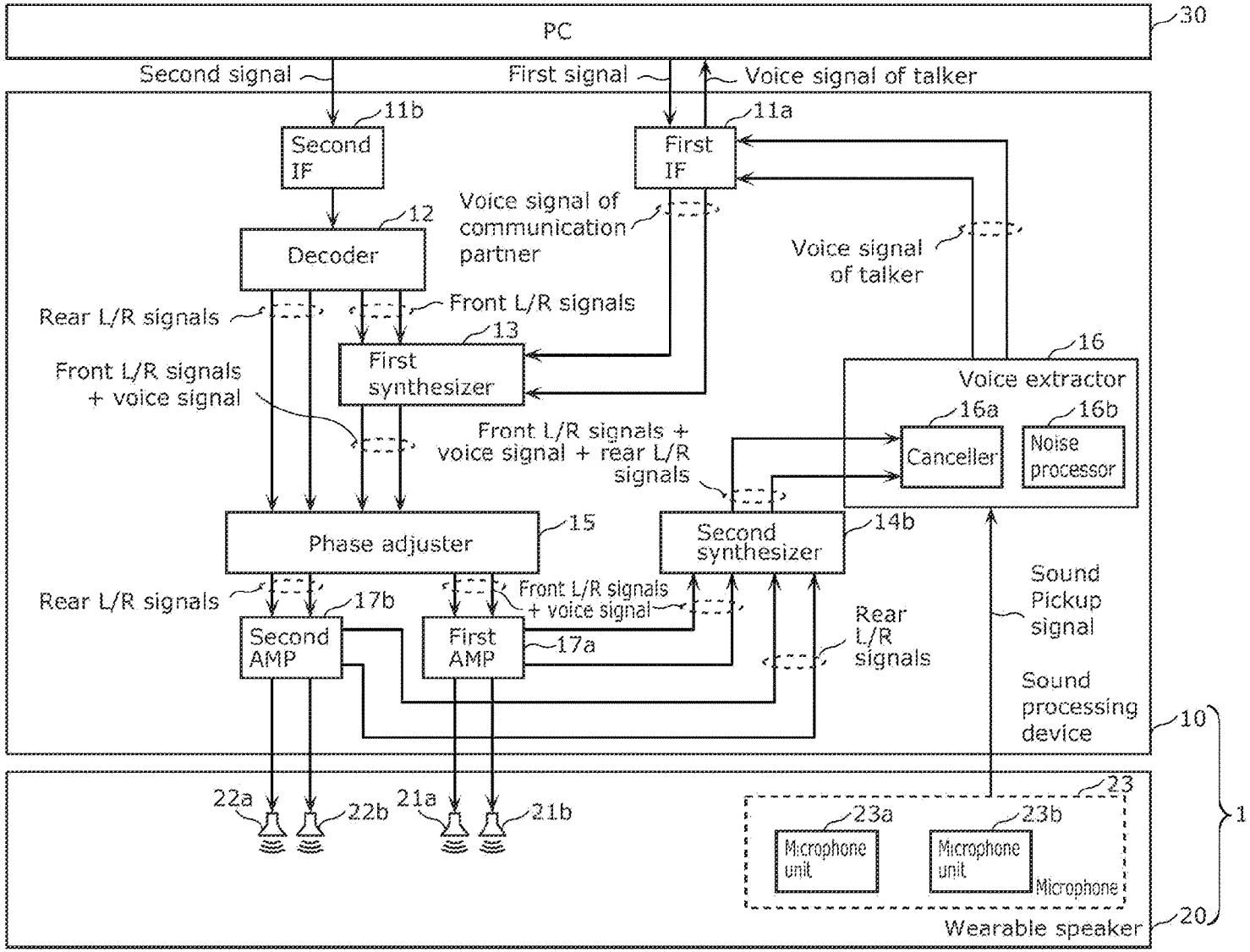
FIG. 4 illustrates a second example of the configuration of the sound processing device according to the embodiment.

FIG. 4 illustrates a second example of the configuration of sound processing device 10 according to the embodiment.

As illustrated in FIG. 4, in the second example, sound processing device 10 is different from the first example in that second synthesizer 14*b* is included instead of second synthesizer 14*a*. Since the other features are the same as those in the first example, the description thereof will be omitted. In the first example, before the signals are amplified by first AMP 17*a* and second AMP 17*b*, second synthesizer 14*a* generates a reference signal of the front L/R signals, the rear L/R signals, and the voice signal of communication partner 200. The signals output from speaker units 21*a*, 21*b*, 22*a* and 22*b* and picked up by microphone 23 are the signals which have been amplified by first AMP 17*a* and second AMP 17*b*, whereas the reference signal generated by second synthesizer 14*a* is the signal before being amplified by first AMP 17*a* and second AMP 17*b*. In other words, in the first example, canceller 16*a* cancels the signals which have been amplified by first AMP 17*a* and second AMP 17*b* by using the reference signal before being amplified by first AMP 17*a* and second AMP 17*b*.

In contrast, in the second example, after the signals are amplified by first AMP 17*a* and second AMP 17*b*, second synthesizer 14*b* generates a reference signal of the front L/R signals, the rear L/R signals, and the voice signal of communication partner 200. Accordingly, canceller 16*a* cancels the signals which have been amplified by first AMP 17*a* and second AMP 17*b* by using the reference signal which has been amplified by first AMP 17*a* and second AMP 17*b*, so that the cancellation can be performed more accurately.

Next, a third example of the configuration of sound processing device 10 will be described with reference to FIG. 5.

Figure 5:
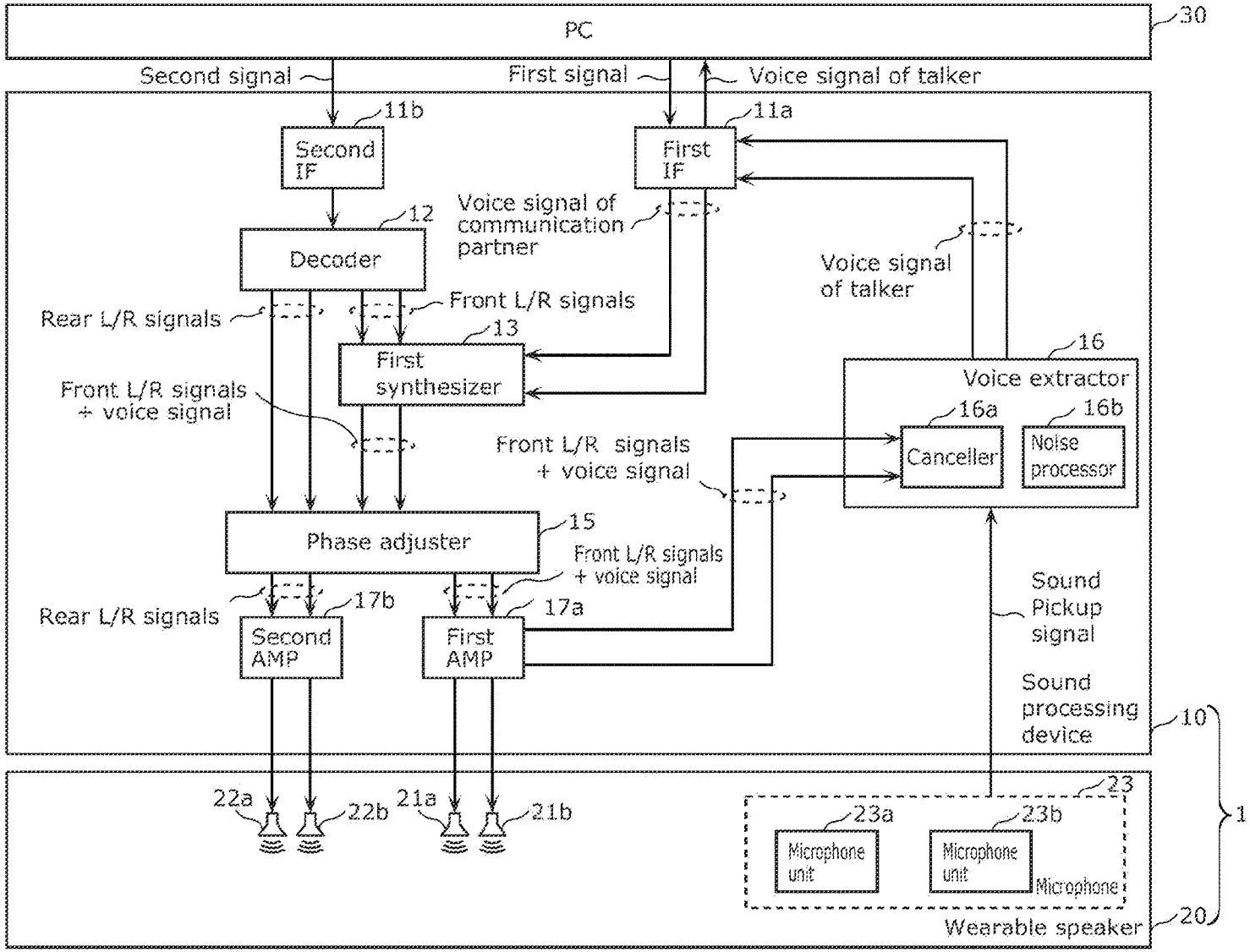
FIG. 5 illustrates a third example of the configuration of the sound processing device according to the embodiment.

FIG. 5 illustrates a third example of the configuration of sound processing device 10 according to the embodiment.

As illustrated in FIG. 5, the third example is different from the second example in that sound processing device 10 does not include second synthesizer 14*b*, and the rear L/R signals are not output from second AMP 17*b* to canceller 16*a*. Since the other features are the same as those in the second example, the description thereof will be omitted.

In the third example, a synthesized signal of the front L/R signals output from first AMP 17*a* and the voice signal of communication partner 200 is input to canceller 16*a* as a reference signal. As illustrated in FIG. 2, microphone 23 and speaker units 21*a* and 21*b* which are front L/R speakers are often arranged close to each other, and microphone 23 and speaker units 22*a* and 22*b* which are rear L/R speakers are often arranged far from each other. In such a case, microphone 23 is highly likely to pick up the sound output from speaker units 21*a* and 21*b*, and is unlikely to pick up the sound output from speaker units 22*a* and 22*b*.

Accordingly, the signals which are output from the speaker units whose output signals are unlikely to be picked up by microphone 23 (for example, the rear L/R signals) do not have to be included in the reference signal. In other words, as in the third example, the reference signal does not always have to include signals output from all the speaker units included in speaker system 1. This simplifies the circuit configuration of sound processing device 10.

Decoder 12, first synthesizer 13, second synthesizers 14*a* and 14*b*, phase adjuster 15 and canceller 16*a* in the first to third examples are, for example, realized by processors (microprocessors) such as digital signal processor (DSP).

Operation of Sound Processing Device

Next, an operation of sound processing device 10 will be described with reference to FIG. 6.

Figure 6:
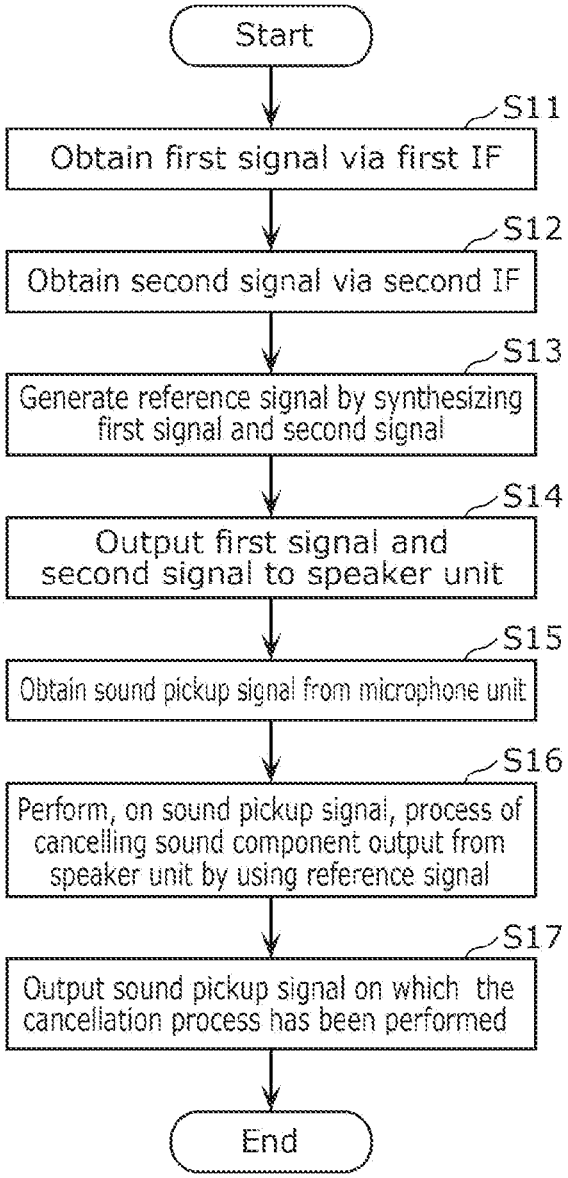
FIG. 6 illustrates an example of an operation of the sound processing device according to the embodiment.

FIG. 6 illustrates an example of an operation of sound processing device 10 according to the embodiment.

Sound processing device 10 obtains the first signal indicating the first sound, which is the voice of communication partner 200 of talker 100, via first IF 11*a* (step S11).

Sound processing device 10 obtains the second signal indicating the second sound different from the first sound via second IF 11*b* different from first IF 11*a* (step S12).

Sound processing device 10 generates a reference signal by synthesizing the first signal and the second signal (step S13).

In the first example of the configuration of sound processing device 10 illustrated in FIG. 3, sound processing device 10 (first synthesizer 13) synthesizes the first signal and the front L/R signals of the second signal. Sound processing device 10 (second synthesizer 14*a*) further generates a reference signal by synthesizing the synthesized signal and the rear L/R signals of the second signal.

In the second example of the configuration of sound processing device 10 illustrated in FIG. 4, sound processing device 10 (first synthesizer 13) synthesizes the first signal and the front L/R signals of the second signal. Sound processing device 10 (second synthesizer 14*b*) further generates a reference signal by synthesizing the synthesized signal which has been amplified and the rear L/R signals of the second signal which have been amplified.

In the third example of the configuration of sound processing device 10 illustrated in FIG. 5, sound processing device 10 (first synthesizer 13) generates a reference signal which is the amplified synthesized signal of the first signal and the front L/R signals of the second signal.

Sound processing device 10 outputs the first signal and the second signal to at least two speaker units included in wearable speaker 20 (step S14). Specifically, sound processing device 10 distributes and outputs the second signal to at least two speaker units by using the position information included in the second signal. More specifically, sound processing device 10 outputs the synthesized signal of the first signal and the front L/R signals (second signal) to speaker units 21*a* and 21*b* via first AMP 17*a*, and outputs the rear L/R signals (second signal) to speaker units 22*a* and 22*b* via second AMP 17*b*.

Sound processing device 10 obtains a sound pickup signal including the voice of talker 100 from at least one microphone unit (here, microphone units 23*a* and 23*b*) included in microphone 23 (step S15). The sound pickup signal may include components of the first signal and the second signal.

Sound processing device 10 performs, on the sound pickup signal, a process of cancelling the sound components output from at least two speaker units by using a reference signal (step S16). Specifically, sound processing device 10 uses a reference signal which is the synthesized signal of the first signal and the second signal to cancel the components of the first signal and the second signal included in the sound pickup signal and output from the speaker units. Since the components of the first signal and the second signal included in the sound pickup signal are originally output from sound processing device 10, sound processing device 10 is capable of easily cancelling the components by using the reference signal of the first signal and the second signal.

Sound processing device 10 outputs the sound pickup signal on which the cancellation process has been performed (step S17). In other words, sound processing device 10 outputs a voice signal obtained by extracting the voice of talker 100 from the sound picked up by microphone 23, as the sound pickup signal on which the cancellation process has been performed. Sound processing device 10 outputs, for example, the sound pickup signal on which the cancellation process has been performed to PC 30 via first IF 11*a*.

Note that, in step S16, sound processing device 10 may perform, on the sound pickup signal, a process of eliminating or reducing noise around microphone 23 in addition to the cancellation process using the reference signal. Subsequently, in step S17, sound processing device 10 may output the sound pickup signal on which the noise eliminating or reducing process has been performed, in addition to the cancellation process.

Another Application Example of Speaker System

Although the example in which the voice chat between talker 100 and communication partner 200 is performed via PC 30 has been described, the voice chat may be performed via a smartphone. Such a case will be described with reference to FIG. 7.

Figure 7:
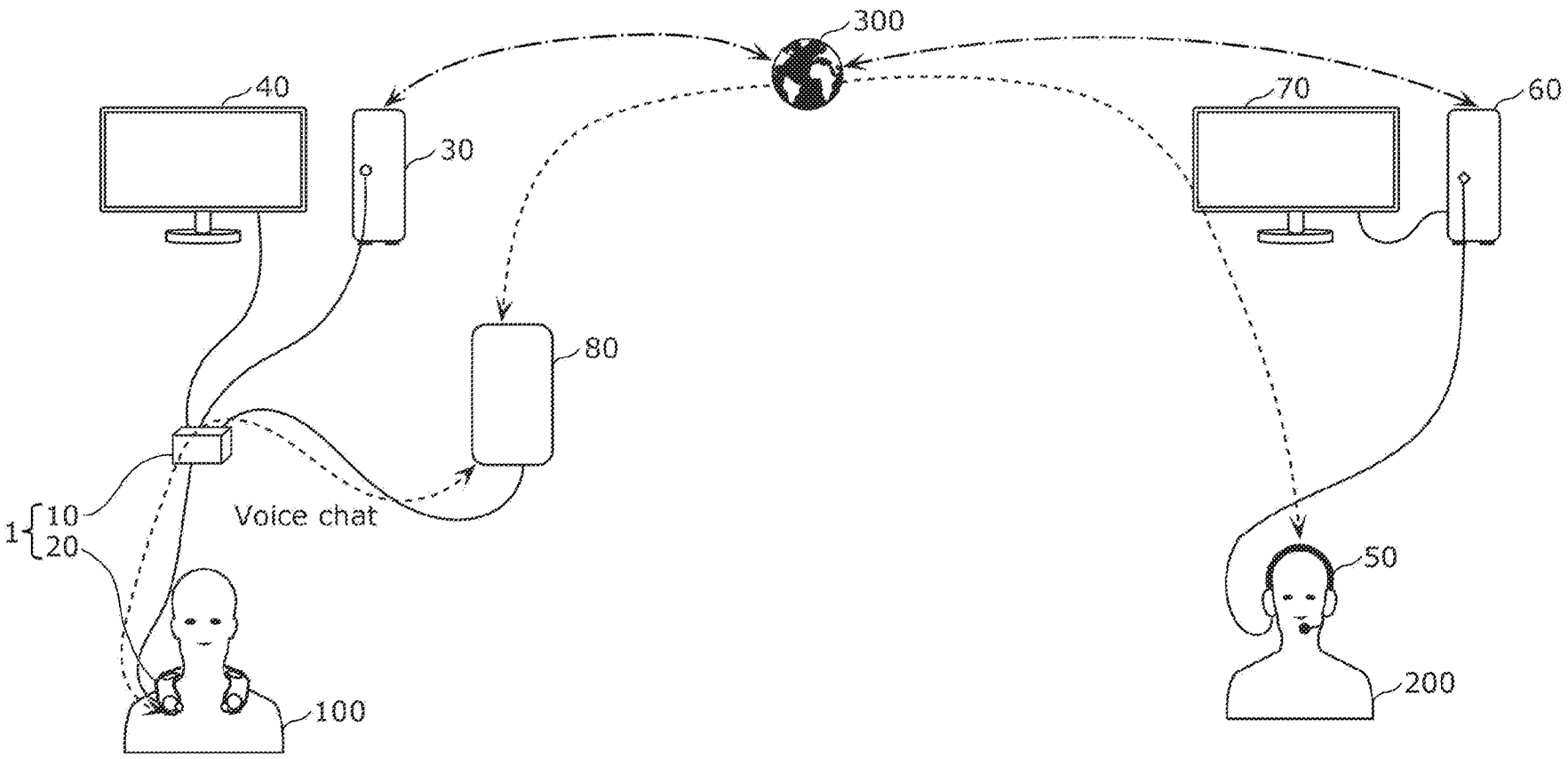
FIG. 7 illustrates another application example of the speaker system according to the embodiment.

FIG. 7 illustrates another application example of speaker system 1 according to the embodiment.

As illustrated in FIG. 7, sound processing device 10 may be connected to smartphone 80, and talker 100 and communication partner 200 may have a voice chat via sound processing device 10 and smartphone 80. In such a case, first IF 11*a* included in sound processing device 10 obtains the voice signal (first signal) of communication partner 200 from smartphone 80, and outputs the voice signal of talker 100 (the sound pickup signal on which the cancellation process has been performed) to smartphone 80. Smartphone 80 and sound processing device 10 may be connected by a 4-pole analog cable or the like via a wired connection, or may be wirelessly connected by Bluetooth (registered trademark) or the like.

Configuration of Wearable Speaker According to Variation

In the above embodiment, the example has been described where wearable speaker 20 includes four speaker units 21*a*, 21*b*, 22*a* and 22*b* as at least two speaker units, but the present disclosure is not limited to such an example. Wearable speaker 20 including two speaker units according to a variation of the embodiment will be described below.

Figure 8:
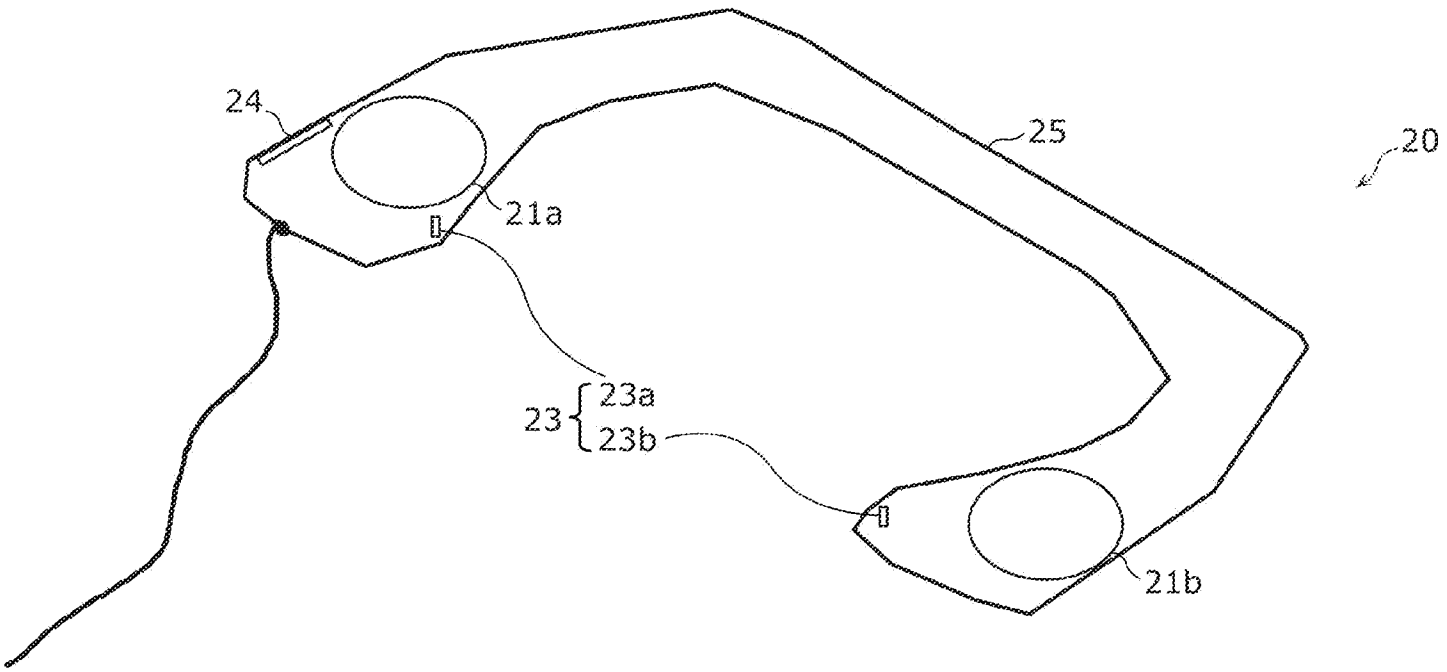
FIG. 8 illustrates an example of a configuration of a wearable speaker according to a variation of the embodiment.

FIG. 8 illustrates an example of a configuration of wearable speaker 20 according to a variation of the embodiment.

Figure 9:
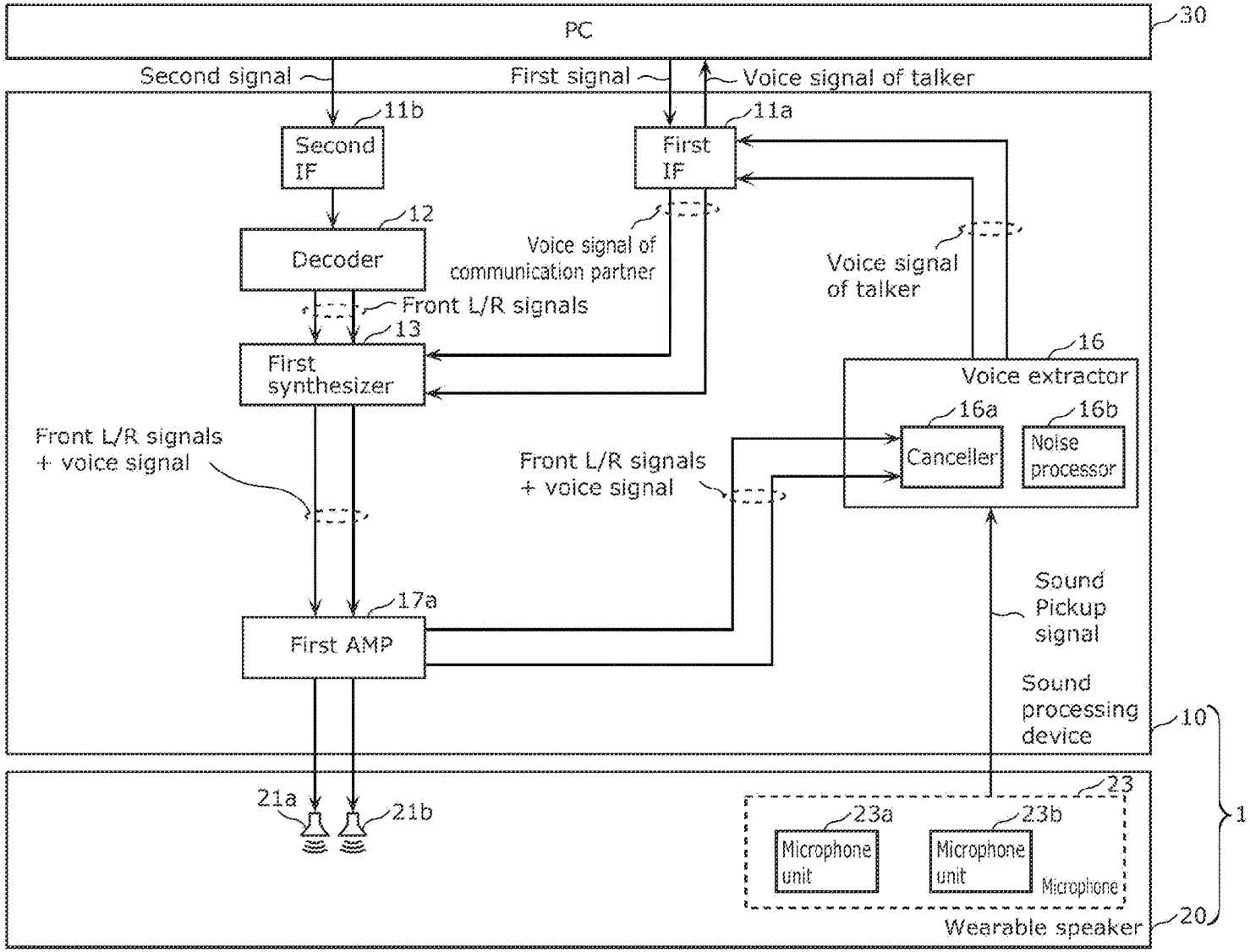
FIG. 9 illustrates an example of a configuration of a sound processing device according to a variation of the embodiment.

FIG. 9 illustrates an example of a configuration of sound processing device 10 according to the variation of the embodiment.

Wearable speaker 20 according to the variation of the embodiment is different from wearable speaker 20 according to the embodiment in that speaker units 22*a* and 22*b* are not included. Since the other features are the same as those in the embodiment, the description thereof will be omitted.

As illustrated in FIG. 8, wearable speaker 20 according to the variation of the embodiment may include only two speaker units. In other words, wearable speaker 20 may be a two-channel speaker. For example, wearable speaker 20 may include only speaker units 21*a* and 21*b* (front L/R speakers). In such a case, in the above first example, sound processing device 10 does not have to include second synthesizer 14*a*, phase adjuster 15, and second AMP 17*b*, and the signal synthesized by first synthesizer 13 serves as a reference signal. In the second example, sound processing device 10 does not have to include second synthesizer 14*b*, phase adjuster 15, and second AMP 17*b*, and the signal output from second AMP 17*b* serves as a reference signal. Moreover, in the third example, sound processing device 10 does not have to include phase adjuster 15 and second AMP 17*b*. FIG. 9 illustrates an example of sound processing device 10 which does not include phase adjuster 15 and second AMP 17*b* in the third example.

Note that wearable speaker 20 according to the variation of the embodiment may include only speaker units 22*a* and 22*b* (rear L/R speakers) instead of speaker units 21*a* and 21*b*.

Advantageous Effects, etc.

As described above, speaker system 1 includes: wearable speaker 20 which is to be worn by talker 100 and which is capable of outputting a first sound which is the voice of communication partner 200 of talker 100 and a second sound different from the first sound; microphone 23 which picks up the voice of talker 100; and sound processing device 10 which processes the sound output from wearable speaker 20 and the sound picked up by microphone 23. Wearable speaker 20 includes at least two speaker units, and microphone 23 includes at least one microphone unit. Sound processing device 10 obtains the first signal indicating the first sound via first IF 11*a*, obtains the second signal indicating the second sound via second IF 11*b* different from first IF 11*a*, generates a reference signal by synthesizing the first signal and the second signal, outputs the first signal and the second signal to at least two speaker units, obtains a sound pickup signal including the voice of talker 100 from at least one microphone unit, performs, on the sound pickup signal, a process of cancelling the sound components output from at least two speaker units by using the reference signal, and outputs the sound pickup signal on which the cancelation process has been performed.

A sound based on the first signal indicating the first sound which is the voice of communication partner 200 and the second signal indicating the second sound (for example, game sound) different from the first sound is output from wearable speaker 20. The output sound is picked up by microphone 23 together with the voice of talker 100. Of the sound components picked up by microphone 23, the sound components output from wearable speaker 20 have the same components as those of the reference signal which is the synthesized signal of the first signal and the second signal generated by sound processing device 10. Accordingly, sound processing device 10 is capable of cancelling the sound output from wearable speaker 20 other than the voice of talker 100 picked up by microphone 23 by using the reference signal. As a result, the voice of talker 100 wearing wearable speaker 20 can be effectively extracted. Since the sound output from wearable speaker 20 is cancelled, talker 100 is capable of comfortably talking with communication partner 200 via microphone 23 without lowering the volume of wearable speaker 20 (for example, a conversation via a text chat application is unnecessary). In addition, since the first signal and the second signal are obtained separately, even if a problem occurs in the second signal, the communication with the first signal can be performed without any problem.

Moreover, it may be that the second signal includes position information, and sound processing device 10 distributes and outputs the second signal to each of at least two speaker units by using the position information. For example, the audio format of the second signal may be bitstream. For example, the second interface may be an interface that is compatible with the HDMI standard.

The position information included in the second signal is information necessary for outputting surround sound. However, for example, when the first signal and the second signal are synthesized by a general-purpose computer, such as PC30, the position information included in the second signal is lost, which makes it difficult to output surround sound from wearable speaker 20. On the other hand, in sound processing device 10, the first signal is obtained from first IF 11*a* and the second signal including the position information is obtained from second IF 11*b*, and the position information included in the second signal is obtained. As a result, the first signal and the second signal can be synthesized without loss of the position information. Hence, it is possible to effectively extract the voice of talker 100 wearing wearable speaker 20 while outputting the surround sound from wearable speaker 20. For example, when the audio format of the second signal is bitstream, the position information can be included in the second signal. For example, when second IF 11*b* is an interface that is compatible with the HDMI standard, sound processing device 10 is capable of obtaining the second signal while including the position information.

The at least two speaker units may include speaker units positioned beside or behind talker 100 when wearable speaker 20 is worn by talker 100.

According to the above aspect, when wearable speaker 20 is worn by talker 100, the speaker unit is positioned beside or behind talker 100, so that sound can be output from beside or behind talker 100, and the talker is capable of feeling a greater realistic sensation. Since wearable speaker 20 is worn by talker 100, even if talker 100 moves, a so-called sweet spot always moves to the optimum position in accordance with the movement of talker 100.

Moreover, the at least two speaker units may include a speaker unit positioned in front of talker 100 when wearable speaker 20 is worn by talker 100.

Normally, when talking with a person (another party), the other party is positioned in front of the talker and the voice of the other party is heard from the front. Accordingly, by positioning the speaker unit in front of talker 100 when wearable speaker 20 is worn by talker 100, it is possible to allow the voice of communication partner 200 to be heard from the front of talker 100 in the same manner as in a normal conversation.

Moreover, it may be that at least two speaker units include two or more speaker units positioned beside or behind talker 100 and two or more speaker units positioned in front of talker 100 when wearable speaker 20 is worn by talker 100.

According to the above aspect, when wearable speaker 20 is worn by talker 100, two or more speaker units are positioned in front of talker 100 and two or more speaker units are positioned beside or behind talker 100. Hence, sound can be output from around talker 100, and talker 100 is capable of obtaining a greater realistic sensation. Additionally, the voice of communication partner 200 can be output from the front of talker 100.

Note that speaker system 1 may further include a speaker separately from wearable speaker 20.

As described above, a speaker (for example, a stationary speaker) may be provided separately from wearable speaker 20.

Moreover, wearable speaker 20 and microphone 23 may be provided integrally.

As described above, wearable speaker 20 and microphone 23 may be provided integrally. For example, in such a case, the cost can be reduced as compared with the case where wearable speaker 20 and microphone 23 are separately provided.

Moreover, wearable speaker 20 and sound processing device 10 may be connected via a wired connection.

For example, in an online game or the like, if the game sound and voice chat sound output from wearable speaker 20 are not in synchronization with the game image, talker 100 will feel uncomfortable or strange. For this, by connecting wearable speaker 20 and sound processing device 10 via a wired connection, communication delay between wearable speaker 20 and sound processing device 10 can be reduced compared with the case where wearable speaker 20 and sound processing device 10 are connected wirelessly. As a result, it is possible to prevent talker 100 from feeling uncomfortable or strange.

Moreover, sound processing device 10 is a device which processes the sound output from wearable speaker 20 which is worn by talker 100 and which is capable of outputting the first sound which is the voice of communication partner 200 of talker 100 and the second sound different from the first sound and a sound picked up by microphone 23 which picks up the voice of talker 100. Sound processing device 10 obtains the first signal indicating the first sound via first IF 11*a*, obtains the second signal indicating the second sound via second IF 11*b* different from first IF 11*a*, generates a reference signal by synthesizing the first signal and the second signal, outputs the first signal and the second signal to at least two speaker units included in wearable speaker 20, obtains a sound pickup signal including the voice of talker 100 from at least one microphone unit included in microphone 23, performs, on the sound pickup signal, a process of cancelling the sound component output from at least two speaker units by using the reference signal, and outputs the sound pickup signal on which the cancelation process has been performed.

According to the above aspect, it is possible to provide sound processing device 10 capable of effectively extracting the voice of talker 100 wearing wearable speaker 20.

Other Embodiments

As described above, an embodiment has been described as an example of the technique disclosed in the present application. However, the technique according to the present disclosure is not limited to the above example, and can be applied to embodiments in which changes, replacements, additions, omissions, etc. are made as appropriate. It is also possible to combine the structural elements described in the above-described embodiment into a new embodiment.

For example, in the above embodiment, it has been described that voice extractor 16 includes noise processor 16*b*, but it may be that voice extractor 16 does not include noise processor 16*b*. In other words, it is sufficient that the process of cancelling the sound components output from at least two speaker units is performed, and the process for eliminating or reducing the noise around microphone 23 does not have to be performed.

Moreover, for example, in the above embodiment, it has been described that the second signal includes the position information of the sound, but the second signal does not have to include the position information. For example, the audio format of the second signal does not have to be bitstream. In such a case, the second signal does not include the position information. Even if PC 30 synthesizes the first signal and the second signal, the second signal does not include the position information in the first place. Hence, no problem occurs. Accordingly, in such a case, PC 30 may synthesize the first signal and the second signal. In this case, sound processing device 10 obtains, via second IF 11*b*, the first signal and the second signal synthesized in PC 30. Sound processing device 10 determines whether or not the signal obtained by second IF 11*b* includes position information (whether or not the audio format is bitstream), and when the signal does not include the position information, first synthesizer 13 does not perform the process.

Moreover, for example, in the above embodiment, the example has been described where a reference signal is generated by synthesizing the front L/R signals output to speaker units 21*a* and 22*b* which are the front L/R speakers and the voice signal of communication partner 200. However, it may be that the rear L/R signals output to speaker units 22*a* and 22*b* which are the rear L/R speakers and the voice signal of communication partner 200 may be synthesized to generate a reference signal.

Moreover, for example, in the above embodiment, the example has been described where PC 30 and sound processing device 10 are separately provided. However, PC 30 may have the functions of sound processing device 10 as long as PC 30 includes a dedicated DSP or the like capable of realizing the functions of sound processing device 10.

Moreover, for example, in the above embodiment, the example has been described where wearable speaker 20 and sound processing device 10 are provided separately. However, wearable speaker 20 and sound processing device 10 may be provided integrally.

Moreover, for example, in the above embodiment, the example has been described where microphone 23 is provided integrally with wearable speaker 20. However, microphone 23 and wearable speaker 20 may be provided separately. In such a case, microphone 23 is attached to talker 100 so as to be positioned near the mouth of talker 100.

Moreover, the present disclosure can be realized not only as speaker system 1 or sound processing device 10, but also as a sound processing method including steps (processes) performed by the structural elements included in sound processing device 10.

Specifically, the sound processing method is a method for processing a sound output from wearable speaker 20 which is worn by talker 100 and which is capable of outputting the first sound which is the voice of the communication partner of talker 100 and the second sound different from the first sound and a sound picked up by microphone 23 which picks up the voice of talker 100. As illustrated in FIG. 6, in the sound processing method, the first signal indicating the first sound is obtained via first IF 11*a* (step S11), and the second signal indicating the second sound is obtained via second IF 11*b* different from first IF 11*a* (step S12), a reference signal is generated by synthesizing the first signal and the second signal (step S13), the first signal and the second signal are output to at least two speaker units included in wearable speaker 20 (step S14), a sound pickup signal including the voice of talker 100 is obtained from at least one microphone unit included in microphone 23 (step S15), a process for canceling the sound components output from at least two speaker units is performed on the sound pickup signal by using the reference signal (step S16), and the sound pickup signal on which the cancellation process has been performed is output (step S17).

For example, those steps may be executed by a computer (computer system). The present disclosure can be realized as a program for causing the computer to execute the steps included in the method. Moreover, the present disclosure can be realized as a non-transitory computer-readable recording medium such as a CD-ROM on which the program is recorded.

For example, when the present disclosure is realized by a program (software), each step is executed by executing the program using hardware resources such as the CPU, memory, and input and output circuit of the computer. In other words, each step is executed when the CPU obtains data from the memory, the input and output circuit, or the like and performs an operation, or outputs the operation result to the memory, the input and output circuit or the like.

Moreover, the structural elements included in sound processing device 10 in the embodiment described above may be realized as a large scale integration (LSI) which is an integrated circuit (IC).

Moreover, the integrated circuit is not limited to the LSI, and may be realized by a dedicated circuit or a general-purpose processor. A programmable FPGA (Field Programmable Gate Array) or a reconfigurable processor in which the connection and settings of circuit cells inside the LSI can be reconfigured may be used.

Furthermore, if an integrated circuit technology that replaces an LSI appears due to advances in semiconductor technology or another technology derived from it, it is natural that the technology is used to create an integrated circuit of the structural elements included in sound processing device 10.

As described above, the embodiment has been described as an example of the technique according to the present disclosure. To that end, the accompanying drawings and detailed explanations have been provided.

Therefore, the structural elements described in the attached drawings and the detailed description may include not only the structural elements essential for solving the problem but also the structural elements not essential for solving the problem. Hence, the fact that these non-essential structural elements are described in the accompanying drawings or detailed description should not immediately determine that those non-essential structural elements are essential.

Additionally, since the above-described embodiment is for illustrating an example of the technique in the present disclosure, various changes, replacements, additions, omissions, etc. can be made within the scope of claims or the equivalent scope thereof.

INDUSTRIAL APPLICABILITY

The present disclosure is applicable to a system used to talk with a communication partner while outputting sound using a wearable speaker.

The invention claimed is:

1. A speaker system, comprising:

a wearable speaker to be worn by a talker, the wearable speaker being capable of outputting a first sound and a second sound which is different from the first sound, the first sound being a voice of a communication partner of the talker;

a microphone which picks up a voice of the talker; and a sound processing device which processes a sound output from the wearable speaker and a sound picked up by the microphone, wherein:

the wearable speaker includes at least two speaker units, the microphone includes at least one microphone unit, and the sound processing device:

obtains a first signal which indicates the first sound via a first interface;

obtains a second signal which indicates the second sound via a second interface which is different from the first interface;

generates a reference signal by synthesizing the first signal and the second signal;

outputs the first signal and the second signal to the at least two speaker units;

obtains a sound pickup signal including the voice of the talker from the at least one microphone unit;

performs, on the sound pickup signal, a cancellation process of cancelling a component of a sound output from the at least two speaker units by using the reference signal; and outputs the sound pickup signal on which the cancellation process has been performed, the at least two speaker units include a first speaker unit positioned beside or behind the talker and a second speaker unit positioned in front of the talker when the wearable speaker is worn by the talker, and the reference signal includes the first signal outputted to the second speaker unit, and does not include the first signal outputted to the first speaker unit.

2. The speaker system according to claim 1, wherein the second signal includes position information of a sound, and the sound processing device distributes and outputs the second signal to the at least two speaker units by using the position information.

3. The speaker system according to claim 2, wherein an audio format of the second signal is bitstream.

4. The speaker system according to claim 1, wherein the second interface is an interface that is compatible with a high-definition multimedia interface (HDMI) (registered trademark) standard.

5. The speaker system according to claim 1, wherein the at least two speaker units include two or more first speaker units positioned beside or behind the talker and two or more second speaker units positioned in front of the talker when the wearable speaker is worn by the talker.

6. The speaker system according to claim 1, further comprising:

a speaker provided separately from the wearable speaker.

7. The speaker system according to claim 1, wherein the wearable speaker and the microphone are provided integrally.

8. The speaker system according to claim 1, wherein the wearable speaker and the sound processing device are connected via a wired connection.

9. A sound processing device which processes a sound output from a wearable speaker to be worn by a talker and a sound picked up by a microphone which picks up a voice of the talker, the wearable speaker being capable of outputting a first sound and a second sound different from the first sound, the first sound being a voice of a communication partner of the talker, the sound processing device:

obtains a first signal indicating the first sound via a first interface;

obtains a second signal indicating the second sound via a second interface different from the first interface;

generates a reference signal by synthesizing the first signal and the second signal;

outputs the first signal and the second signal to at least two speaker units included in the wearable speaker;

obtains a sound pickup signal including the voice of the talker from at least one microphone unit included in the microphone;

performs, on the sound pickup signal, a cancellation process of canceling a component of a sound output from the at least two speaker units by using the reference signal; and outputs the sound pickup signal on which the cancellation process has been performed wherein:

the at least two speaker units include a first speaker unit positioned beside or behind the talker and a second speaker unit positioned in front of the talker when the wearable speaker is worn by the talker, and the reference signal includes the first signal outputted to the second speaker unit, and does not include the first signal outputted to the first speaker unit.

10. A sound processing method for processing a sound output from a wearable speaker to be worn by a talker and a sound picked up by a microphone which picks up a voice of the talker, the wearable speaker being capable of outputting a first sound and a second sound different from the first sound, the first sound being a voice of a communication partner of the talker, the sound processing method comprising:

obtaining a first signal indicating the first sound via a first interface;

obtaining a second signal indicating the second sound via a second interface different from the first interface;

generating a reference signal by synthesizing the first signal and the second signal;

outputting the first signal and the second signal to at least two speaker units included in the wearable speaker;

obtaining a sound pickup signal including the voice of the talker from at least one microphone unit included in the microphone;

performing, on the sound pickup signal, a cancellation process of canceling a component of a sound output from the at least two speaker units by using the reference signal; and outputting the sound pickup signal on which the cancellation process has been performed wherein:

the at least two speaker units include a first speaker unit positioned beside or behind the talker and a second speaker unit positioned in front of the talker when the wearable speaker is worn by the talker, and the reference signal includes the first signal outputted to the second speaker unit, and does not include the first signal outputted to the first speaker unit.

11. A non-transitory computer-readable recording medium for use in a computer, the recording medium having a computer program recorded thereon for causing the computer to execute the sound processing method according to claim 10.

* * * * *